US005209953A

United States Patent [19]

Grupe et al.

[11] Patent Number: 5,209,953

[45] Date of Patent: May 11, 1993

[54] OVERALL PRINTING OF TISSUE WEBS

[75] Inventors: Edward H. Grupe, Appleton; Lee P. Garvey, Little Chute; Mike T. Goulet, Appleton, all of Wis.

[73] Assignee: Kimberly-Clark Corporation, Neenah, Wis.

[21] Appl. No.: 958,433

[22] Filed: Oct. 7, 1992

Related U.S. Application Data

[63] Continuation of Ser. No. 515,982, Apr. 27, 1990, abandoned, which is a continuation-in-part of Ser. No. 389,034, Aug. 3, 1989, abandoned.

[51] Int. Cl.[5] ..... B05D 5/00; D06P 7/00

[52] U.S. Cl. ..... 427/276; 8/500; 8/919; 101/170; 427/288

[58] Field of Search ..... 428/153, 154, 211; 101/170; 8/495, 500, 919; 427/288, 276

[56] References Cited

U.S. PATENT DOCUMENTS 2,089,949 8/1937 Drewsen ..... 101/153
2,380,047 7/1945 Hyman ..... 427/288 X
2,649,386 8/1953 Snowman, Jr. ..... 162/135 X

FOREIGN PATENT DOCUMENTS 2093283 1/1972 France .
2289992 10/1974 France .
1140083 1/1969 United Kingdom .
2046666A 11/1979 United Kingdom .

OTHER PUBLICATIONS

Adams, M. et al., "Printing Technology," 3rd edition, Albany, N.Y., Delmar Publishers, Inc., 1988, pp. 181–184.

*Primary Examiner*—Evan Lawrence
*Attorney, Agent, or Firm*—Gregory E. Croft

[57] ABSTRACT

Printing of a surface of a tissue web, such as used for facial and bath tissue, with a colorant in a pattern of small colored areas. From about 5 to about 25 percent of the surface is covered by the small colored areas, so that the surface macroscopically appears to be a solid color.

12 Claims, 2 Drawing Sheets

OVERALL PRINTING OF TISSUE WEBS

This is a continuation of copending application Ser. No. 07/515,982 filed on Apr. 27, 1990, now abandoned, which is a continuation-in-part of U.S. Ser. No. 07/389,034 filed on Aug. 3, 1989, now abandoned.

BACKGROUND OF THE INVENTION

In the manufacture of tissue products, such as bath tissue, coloring the tissue is accomplished by the addition of a colored dye to the fiber furnish prior to the formation of the wet laid web. Product color changes are effected by running all of the dyed furnish out of the papermaking machine, rinsing the system, and starting up again with a new color. There is considerable waste and delay associated with this type of operation due to the down time necessary for purging the papermaking machine of the prior color, as well as placing limitations on recycling colored broke.

SUMMARY OF THE INVENTION

It has now been discovered that a substantial manufacturing cost savings and a reduction of the use of colored dyes can be achieved by printing at least one outer surface of a tissue web with an overall pattern of small areas which are of a color or brightness different from the remaining unprinted area of the tissue web. Specifically, the tissue web can be printed with an ink, dye, or whitener/brightener (all hereinafter referred to as colorants) to impart an overall pattern (hereinafter defined) of small colored areas to the tissue web which, in the eye of an ordinary observer, gives the appearance of a solid color on the printed side as if the tissue furnish were colored conventionally. At the same time, the color of the other side of the tissue is virtually unaffected and, if only the one side of the web is colored, remains substantially uncolored. This is a surprising result because tissue webs are typically very thin, highly absorbent and weak, particularly when exposed to aqueous solutions, and would be expected to fall apart, or at least permit the color to bleed through if exposed to a printing process. Nevertheless, it has been found that one side of such webs can appear to be solidly colored without adversely affecting the properties of the tissue required for its end use.

For purposes herein, "color" includes true color, such as the colors of the visible spectrum, as well as white and different levels of brightness. In the case of true colors, the printed side of the tissue web appears to be a solid color and the presence of the unprinted background area of the same tissue web surface, if white, imparts to the color a higher degree of brightness than a conventionally dyed web of the same color would have. A major advantage of the process of this invention is that a tissue machine can be operated making only white tissue, thus eliminating color changes and the associated down times and start-up problems as well as reducing inventories of different colored rolls. On the other hand, the invention is not limited to printing on white tissue. For example, the tissue can be of one color prior to printing and thereafter printed to achieve a different color on one or both sides. In addition, a series of printing stations can be used to print a combination of primary colors to achieve any desired apparent color such as, for example, printing blue followed by printing yellow to obtain green.

Hence in one aspect, the invention resides in a method of making a colored tissue web comprising printing the surface of a tissue web with a colorant to provide an overall printed pattern of small colored areas, wherein the small colored areas cover at least about 5 percent of the surface area of the overall printed pattern of the tissue web without rendering the tissue web unsuitable for use.

In a further aspect, the invention resides in a tissue web, at least one of the two outer surfaces of which contains an overall printed pattern of small colored areas which are of a color different from the remaining area of the tissue surface, said small areas of different color covering at least about 5 percent of the total surface area of the overall printed pattern of the tissue web and imparting a solid color appearance to the printed surface.

For purposes herein, a tissue web is a cellulosic web suitable for making or use as a facial tissue, bath tissue, paper towels, or the like. It can be layered or unlayered, creped or uncreped, and is preferably a single ply web, but can also be of two or more plies. In addition, the tissue web can contain reinforcing fibers for integrity and strength. Tissue webs suitable for use in accordance with this invention are characterized by being absorbent, of low density and relatively fragile, particularly in terms of wet strength. Densities are typically in the range of from about 0.1 to about 0.3 grams per cubic centimeter. Absorbency is typically about 5 grams of water per gram of fiber, and generally from about 5 to about 9 grams of water per gram of fiber. Wet tensile strengths are generally about 0 to about 300 grams per inch of width and typically are at the low end of this range, such as from about 0 to about 30 grams per inch. Dry tensile strengths in the machine direction can be from about 100 to about 2000 grams per inch of width, preferably from about 200 to about 350 grams per inch of width. Tensile strengths in the cross-machine direction can be from about 50 to about 1000 grams per inch of width, preferably from about 100 to about 250 grams per inch of width. Dry basis weights are generally in the range of from about 5 to about 60 pounds per 2880 square feet. The tissue webs referred to above are preferably made from natural cellulosic fiber sources such as hardwoods, softwoods, and nonwoody species, but can also contain significant amounts of recycled fibers, sized or chemically-modified fibers, or synthetic fibers. After printing, the tissue webs can be plied together to form multiply tissue products.

For purposes herein, an "overall pattern" is a printed pattern which macroscopically covers substantially the entire surface of the tissue web, as viewed in the eye of a casual observer such as a typical tissue user. Although macroscopic coverage of the entire surface of the tissue web is preferred, it is within the scope of this definition that the overall pattern macroscopically cover less than the entire surface of the tissue web. An example of covering less than the entire surface of the tissue web includes, without limitation, a tissue web having decorative unprinted areas interspersed within the overall pattern, such as a butterfly or floral pattern. In such a situation, for example, a roll of blue bath tissue having a decorative white floral pattern can be produced by printing an overall pattern of blue onto a white tissue web, but leaving individual unprinted areas having the shape of a flower. This is easily accomplished by properly designing the printing operation to not apply colorant in the white decorative areas. Other examples of less than total surface coverage include leaving the edges of the tissue web unprinted or leaving unprinted areas which are in the form of alphanumeric indicia. In the instances where less than total coverage is desired, it is preferred that the overall pattern macroscopically cover from about 75 to about 95 percent of the surface area of the tissue web, and most preferably from about 85 to about 95 percent in order to give the appearance of a solid background color.

On a microscopic level, as opposed to the macroscopic level referred to above, the surface area coverage provided by the small colored areas making up the overall pattern is at least about 5 percent of the surface area of the overall pattern of the tissue web. (As used herein, "surface area" is the planar area of the tissue web as viewed from above in a plan view. Surface contours in the web are not taken into account.) As the surface area occupied by the small colored areas increases, the quality or intensity of the solid color imparted by the overall pattern improves, but there can be a tendency to degrade the tissue web if too much colorant is added and the tissue web becomes too wet, particularly when using aqueous colorants. In this regard it is believed that after printing on the colorant, drying of the tissue web is achieved by wicking and absorption of the colorant by the fibers of the tissue web which lie in the x-y plane of the tissue web. This is particularly true for aqueous dye colorants. If the entire surface of the tissue web is saturated with colorant, the colorant can no longer be effectively wicked away, since relatively few fibers are normally oriented in the z-direction of the web. Therefore at very high surface area coverage levels, it is important to carefully control the add-on amount of colorant in order to confine the colorant to the surface of the tissue web. For this reason the surface area occupied by the small colored areas should be less than 100 percent. Preferably, the surface area coverage is from about 5 to about 60 percent, more preferably from about 5 to about 25 percent, and most preferably from about 5 to about 15 percent. A surprising advantage of printing webs in accordance with this invention is that in most instances the printed web can be immediately embossed after printing because drying of the web is almost instantaneous. Hence an embossing module can be positioned in line immediately downstream of the printing operation.

The degree of penetration of the ink into the tissue web should be limited as much as possible to avoid using unnecessary amounts of ink and to avoid substantially affecting the properties of the tissue web. This is particularly true for water-based inks, which can adversely affect strength, stiffness and density of the tissue web by introducing additional bonding within the tissue. Preferably, the inks are confined to the outermost fibers. This is most easily accomplished with pigment-based colorants containing polymeric vehicles, whereas substantive dyes have a greater tendency to migrate and penetrate the tissue web. Numerically, penetration is preferably limited to an average of about 60 percent of the web thickness or less. More preferably, the penetration of colorant is limited to about 30 percent or less of the web thickness, and most preferably about 20 percent or less. By limiting the penetration of the colorant in this manner, the method of this invention provides a tissue web with the unique characteristic of having a solid color appearance on one side and a substantially uncolored appearance on the opposite side.

For purposes herein, "a substantially uncolored" appearance on the unprinted side means that the color difference between the printed side and the unprinted side of the web is substantial and the color of the unprinted side is minimally affected by the printing of colorant on the printed side. In those instances where the web is white on both sides prior to printing colorant on the printed side, it is preferred that the color difference is at least 20 percent, and preferably at least 30 percent, as measured by averaging the percent change of the Hunterlab Color "a" and "b" values (hereinafter defined) from one side of the web to the other side. The formula for calculating this color difference is: $50[2-(a_1/a_2)-(b_1/b_2)]$, wherein "$a_1$" and "$b_1$" are the Hunterlab Color "a" and "b" values for the unprinted side of the web and "$a_2$" and "$b_2$" are the Hunterlab Color "a" and "b" values for the printed side of the web. If both sides of the web are printed, for purposes herein "substantially uncolored" means that the printing of one side has no substantial effect on the color of the unprinted side. In either case, the colored web has substantially the same density and stiffness (softness) as the untreated or uncolored web prior to printing. This is especially unique for low basis weight webs of facial or bath tissue weights (about 5 to about 20 pounds per 2880 square feet) which are very thin. Single ply webs of this invention can be combined into a two ply product having the printed sides out, or can be utilized as a one ply product having sides of two different colors. For bath tissue, for instance, wherein the tissue web is wound onto a roll such that only one side of the web is displayed during end-use, it is advantageous to have the printed side out and the unprinted side in. Of course, the method of this invention can be applied to both sides of a single ply web if a single ply product having both sides of the same or different colors is desired. In addition, decorative patterns can be printed on top of the overall-printed web.

The add-on amount of colorant will be as little as possible while sufficient to impart the desired color to the tissue web. The amount will depend upon the nature of the particular tissue web being treated, but in general can be from about 0.1 to about 3 milligrams per square inch of surface per side, and preferably from about 0.2 to about 1.5 milligrams per square inch.

As previously mentioned, also within the scope of this invention are the printing of bleaches, whiteners or brighteners to increase the whiteness or brightness of a tissue. Such a process is more economical and more flexible than treating all of the fibers prior to tissue formation as is the current practice. Softening agents can also be added in this manner to improve the feel of the sheet.

The method of this invention can be applied at any point in the manufacturing process after the tissue web is sufficiently dry to accept the colorant being printed thereon. It is convenient to print the tissue between manufacturing and converting, thus avoiding any difficulties associated with high manufacturing line speeds. For example, the creped tissue web can be printed between the parent roll (soft roll) and the hardroll during rewinding. Alternatively, the creped tissue web can be printed as the hardroll is being unwound, prior to cutting or slitting. However, the tissue web can also be printed between the creping cylinder and the parent roll or between drying and the creping doctor blade if desired. In any case, it is preferred that the printing precede any embossing step which would impart surface irregularities and make overall printing more difficult. As previously mentioned, because the interaction of the colorant and the tissue web is such that drying of the tissue web is substantially instantaneous, in-line embossing of the printed tissue web immediately following the printing step is easily accomplished. In-line printing immediately followed by embossing is an unexpected combination because printing to obtain overall coloration of a tissue web would ordinarily be expected to leave the web too moist to process or, at a minimum, too moist to achieve good embossing definition.

It is also preferred that rotogravure printing, which is a common, well known printing process, be used to apply the colorant to the creped tissue web because of the high degree of control provided by the rotogravure process. However, other printing methods can also be used such as, without limitation, offset gravure, and flexography.

Although the benefit of practicing this invention is most clearly illustrated in connection with printing colored inks and dyes, the method of this invention also can be utilized to deliver additional substances such as adhesives, web strength additives, lotions, fire retardants, disposal aids, and the like.

Suitable colorants for printing onto the tissue web include solvent- and water-based inks and substantive dyes in an unlimited range of colors. The amount of colorant applied to the tissue web will depend upon the particular colorant composition, its color intensity, and the desired color intensity of the final product.

The size of the small colored or brightened areas imparted to the tissue web by the printing method described herein must be sufficiently small so that they are not individually detectable by the naked eye. Because of the irregular shape of the colored or brightened areas, which is particularly true when using dyes which readily wick along the fiber network of the tissue web, the size of these printed areas can be specified with only limited precision. The spacing of these printed areas will depend upon their size and the desired surface area coverage, as well as the particular colorant being used.

For purposes herein, color measurement and brightness for tissue samples are measured using a Hunterlab Color Difference Meter, Model No. D25-9. Hunterlab Color is a well known color measurement which is expressed in terms of three values: Rd, "a", and "b". Rd represents the percent diffuse reflectance (brightness) which ranges from 0 (black) to 100 (white). The "a" value is a measure of the redness (+a) and greenness (−a). The "b" value is a measure of yellowness (+b) and blueness (−b). For both the "a" and "b" values, the greater the departure from 0, the more intense the color.

In measuring the Hunterlab Color for a particular tissue sample, a stack of tissue samples is placed on the Hunterlab Color Difference Meter beneath the optical light sensor. The reason it is necessary to use a stack of the sample tissues is that the sample must be sufficiently thick to prevent light from penetrating the sample and reflecting back through the sample from the background sample support surface to give a false reflectance reading. For tissue samples having a basis weight of from about 7 to about 20 pounds per 2880 square feet per ply, about 40 plies are needed to form the stack. The number of plies will of course vary with the density and thickness of the test sample. In all cases, it is necessary that the test side of each ply within the sample stack be facing toward the optical light sensor.

DETAILED DESCRIPTION OF THE DRAWING

Figure 1:
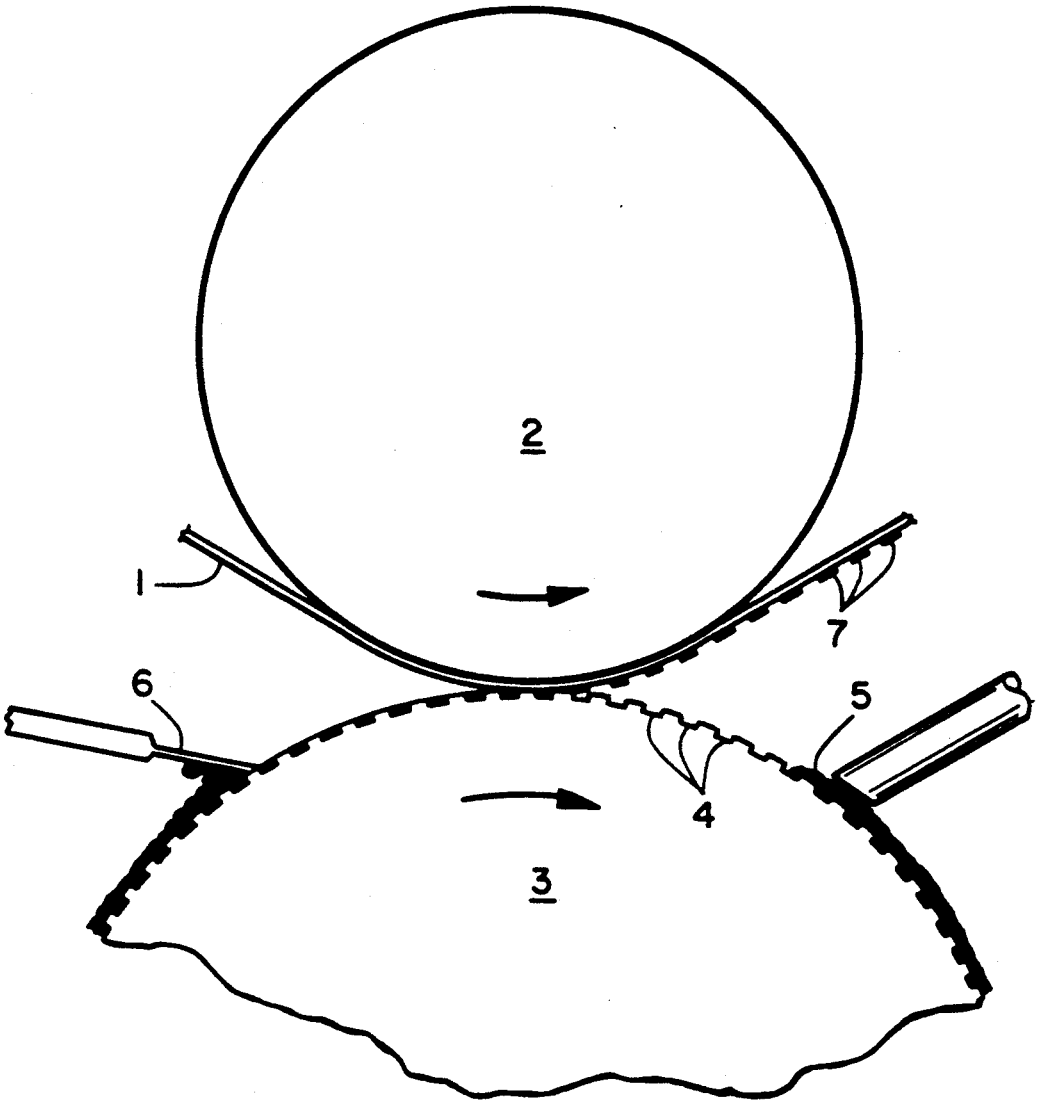
FIG. 1 is a schematic view of a rotogravure printing unit, illustrating the rotogravure printing process.

Referring to the drawing, the invention will be described in greater detail.

FIG. 1 is a schematic diagram of a rotogravure printing unit useful in the method of this invention. Shown is a tissue web 1 being passed between a rubber impression roller 2 and a gravure cylinder 3. The surface of the gravure cylinder contains a large number of depressions or cells 4 which are designed to receive, hold, and transfer colorant to the tissue web. Colorant or brightener 5 is applied to the surface of the gravure cylinder downstream of the nip and is removed from the land areas of the gravure cylinder with a doctor blade 6. As the tissue web enters the nip area, it is pressed against the gravure cylinder by the rubber impression roller, thereby permitting the colorant or brightener to transfer from the gravure cylinder cells and be deposited on the surface of the tissue web in small colored or brightened areas 7 corresponding to the individual gravure cylinder cells. When printing with inks, the overall pattern of small colored or brightened areas remains relatively intact in the final tissue product. In such instances, the percentage of the surface area of the tissue web covered by the colored areas will closely match the percentage of the surface area of the gravure roll covered by the gravure cells. However, as will be illustrated in FIG. 3, this relationship may not hold when using dye inks which have a greater tendency to migrate. Nevertheless, as long as the small colored or brightened areas initially applied to the tissue web by the printing process are of proper size and spacing to cover the necessary minimum fraction of the surface area of the overall pattern printed onto the tissue web, the overall pattern of the tissue web will appear to be a solid color. As previously mentioned, the rotogravure cell size and the number of cells per square inch will depend on a number of factors, including the flow characteristics of the colorant, the intensity of the colorant, and the desired surface area coverage.

The loading between the rubber impression roller and the gravure cylinder should be as low as possible to avoid permanent compaction of the tissue web, suitably about 100 pounds per lineal inch (pli) or less, and preferably about 40 pli. The rubber impression roller correspondingly can have a hardness of about 90 Shore A durometer or less, preferably about 70. Operation of the printer should be such as to avoid decreasing the bulk of the tissue web, which means not only minimizing the nip pressure, but also minimizing the amount of moisture added to the tissue web during printing in order to minimize the formation of new papermaking bonds.

Web speeds through the rotogravure printing process can be from about 600 or less to about 5000 feet per minute, allowing the printing to be accomplished on-line during web manufacture or subsequently during converting.

Figure 2:
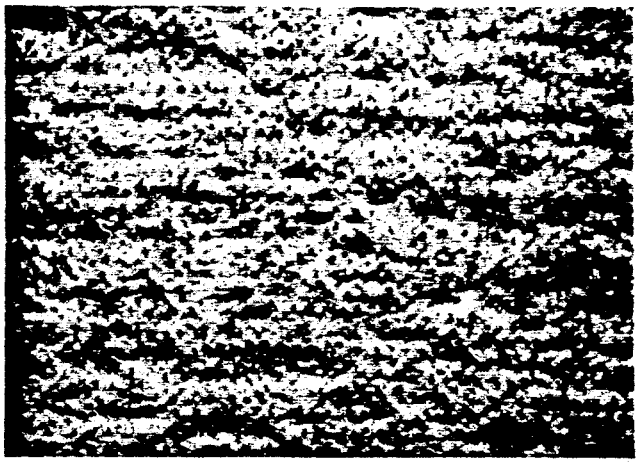
FIG. 2 is a plan view photograph (10×) of a creped tissue web which has been printed with an overall pattern of a pigment-based ink in accordance with this invention.

FIG. 2 is a plan view photograph (10×) of a creped tissue web in accordance with this invention. The photograph illustrates an example of a degree of overall surface coverage suitable to achieve the appearance of a solid color as viewed by an ordinary observer or end-user of the product. Shown is the creped tissue web surface and a multiplicity of small colored areas 21, which in this instance are deposits of a water-based pigment ink (blue, manufactured by Converters Ink Company, Neenah, Wis.) covering about 20 percent of the surface area of the tissue web. It should be noted that the same rotogravure roll, when using a substantive dye colorant, will produce small colored areas which immediately transform into a pattern vastly different in character than that shown in FIG. 2. (See FIG. 3).

Figure 3:
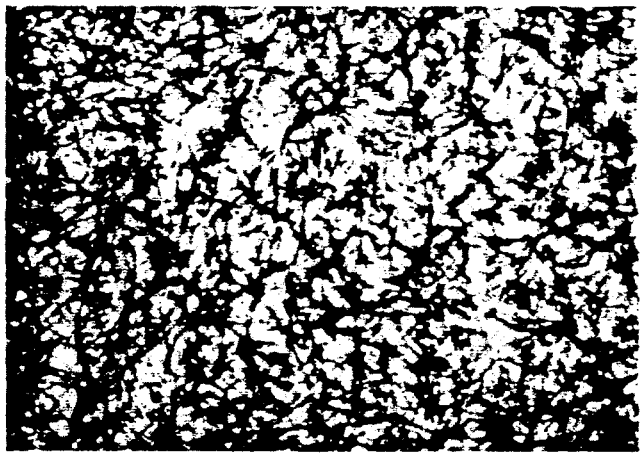
FIG. 3 is a plan view photograph (10×) of a creped tissue web which has been printed with an overall pattern of a dye ink in accordance with this invention, illustrating the diffusion of the dye ink along the fiber network in the x-y plane of the tissue web.

FIG. 3 illustrates a different embodiment of this invention in which the tissue web has been printed with an overall pattern of small blue colored areas 21 using a substantive dye ink. As shown, the shape or nature of the small colored areas imparted to the tissue web by the gravure cylinder has changed dramatically because the dye migrates along the surface fibers. For purposes herein, these colored surface fibers are considered to be small colored areas, notwithstanding that their shape is very irregular and no longer corresponds to the shape of the gravure cell. If desired, the percentage of surface area coverage provided by the colored or brightened areas can be determined using image analysis, provided the colorant or brightener can be distinguished from the base color of the tissue web.

Figure 4:
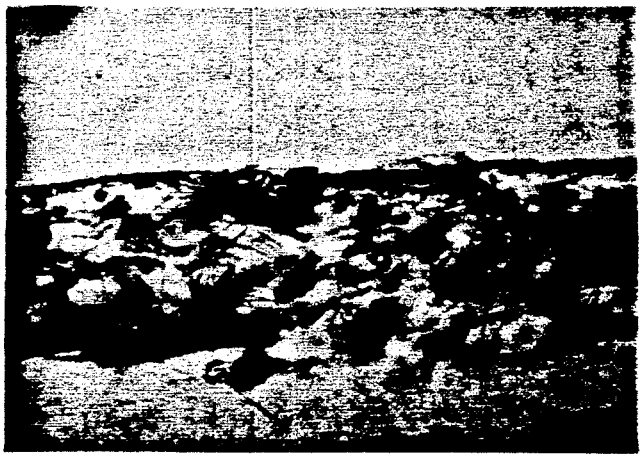
FIG. 4 is a cross-sectional photograph (100×) of a creped tissue web of the type illustrated in FIG. 3, illustrating the partial penetration of the dye ink into the tissue web.

FIG. 4 is a cross-sectional photograph (100×) of a creped tissue web in accordance with this invention, further illustrating the nature of the small colored areas 21, which in this case are blue dye ink deposits of the type illustrated in FIG. 3. As shown, although the dye inks have a greater tendency to penetrate the tissue web surface, the colored areas 21, which are outlined with a solid line, are still substantially confined to the surface of the tissue web.

EXAMPLES

Example 1

Water-based Pigment Ink (Beige)

A white single-ply creped tissue web, having a finished basis weight of 17.4 pounds per 2880 square feet and a furnish consisting of 60% hardwood and 40% softwood fibers, was printed on one side with a beige water-based dye ink (W126105 Series 5 Beige supplied by Converters Ink Company, Linden, N.J.). The printer (Arrow Equipment Mfg.) had a rubber impression roller having a 70 Shore A hardness. The gravure cylinder had acid-etched cells having a cell volume of 1 billion cubic microns per square inch of gravure cylinder surface. Each cell had an open top area of 9000 square microns and a cell depth of about 20 microns. Tissue surface area coverage was about 20 percent. Moisture add-on during the printing process was 8 pounds per ton of tissue web. Ink solids add-on was 2 pounds per ton. The resulting tissue appeared to be solid beige on one side when viewed with the naked eye. The other side of the tissue was white. Hunterlab Color measurements for the printed side of the tissue web were: Rd=90.56; a=−1.42; b=13.53. Hunterlab Color measurements for the unprinted (white) side of the tissue web were: Rd=91.11; a=−0.80; b=10.56.

As a comparison, a conventionally-dyed tissue web of the same basis weight and same apparent color was measured for Hunterlab Color. The corresponding Hunterlab Color values were: Rd=89.19; a=−0.28; b=14.43. These results indicate that the printed side of the tissue web of this invention had greater brightness, but the same color, as the conventionally-dyed tissue web. In addition, the unprinted side remained substantially uncolored.

Example 2

Water-based Pigment Ink (Yellow)

Overall printing of a tissue web was carried out as described in Example 1, except the beige colorant was replaced with a yellow pigment ink (W126105 Series 5 Yellow, also supplied by Converters Ink Company). Hunterlab Color values for the printed side of the tissue web were: Rd=90.89; a=−6.62; b=27.07. Hunterlab Color measurements for the unprinted side of the tissue web were: Rd=91.42; a=−4.27; b=19.67. The corresponding Hunterlab Color values for a Conventionally-dyed tissue web of the same basis weight and same apparent color were: Rd=90.35; a=−6.67; b=28.87.

Example 3

Water-based Pigment Ink (Blue)

Overall printing of a tissue web was carried out as described in Example 1, except the beige colorant was replaced with a blue pigment ink (F68924 Blue Ink supplied by A. J. Daw Printing Ink Co., Neenah, Wisconsin). Hunterlab Color values for the printed side of the tissue web were Rd=79.38; a=−5.65; b=−4.36. Hunterlab Color measurements for the unprinted side of the tissue web were: Rd=81.95; a=−4.54; b=−2.45. The corresponding Hunterlab Color values for a conventionally-dyed tissue web of the same basis weight and same apparent color were: Rd=68.23; a=−8.88; b=−11.73.

Example 4

Cationic Direct Dye (Blue)

A white single-ply creped tissue web, having a finished basis weight of 15.63 pounds per 2880 square feet and a furnish consisting of 60 percent hardwood and 40 percent softwood fibers, was printed on one side with a blue cationic direct dye (Aquonium Turquoise supplied by Hilton-Davis, Co., Cincinnati, Ohio). The printer (Arrow Equipment Mfg.) had a rubber impression roller have a 70 Shore A hardness. The gravure cylinder had mechanical etched cells having a cell volume of 430 million cubic microns per square inch of gravure cylinder surface. Each cell had an open top area of 6000 square microns and cell depth of about 10 microns. Dye add-on as determined by quantitative analysis was 0.21 milligrams per square inch. The resulting tissue appeared to be solid blue on one side when viewed with the naked eye. The other side of the tissue was white. Hunterlab color measurements for the printed side of the tissue web were: Rd=68.07; a=−8.66; b=−11.21. Hunterlab color measurements for the unprinted side of the tissue web were: Rd=73.24; a=−6.00; b=−8.12.

This indicates the unprinted side of the one-ply product remained substantially uncolored.

Example 5

Cationic Direct Dye—(Orange)

A white two-ply creped tissue web, having a finished basis weight of 17.5 pounds per 2880 square feet and a furnish consisting of 60 percent hardwood and 40 percent softwood fibers, was printed on one side with an orange cationic direct dye (Fastusol Orange 59 LU supplied by BASF Corporation, Parsippany, N.J.). The printer (Arrow Equipment Mfg.) had a rubber impression roller having a 70 Shore A hardness. The gravure cylinder had mechanical etched cells having a cell volume of 1.6 billion cubic microns per square inch of gravure cylinder surface. Each cell had an open top area of 10,000 square microns and a cell depth of about 14 microns. Tissue surface area coverage was about 22 percent. Dye add-on, determined by quantitative analysis, was 1.3 milligrams per square inch. The resulting tissue appeared to be solid orange on one side when viewed with the naked eye. The other side of the tissue was white. Hunterlab color measurements for the printed side of the tissue web were: Rd=65.92; a=14.35; b=18.20. Hunterlab color measurements for the unprinted side of the tissue web were: Rd=74.58; a=9.27; b=8.47. This indicates the unprinted side of the two-ply product remained substantially uncolored.

Example 6

Cationic Direct Dye (Orange)

Overall printing of a creped tissue web was carried out as described in Example 5, except that for test purposes the tissue plies were separated and Hunterlab Color measurements were taken only of the tissue ply in contact with the dye. Hunterlab color measurements for the printed side of the tissue ply were: Rd=57.02; a=19.30; b=20.86; Hunterlab Color measurements for the unprinted side of the tissue ply were: Rd=62.91; a=15.26; b=14.89. This indicates the unprinted side of the tissue ply was substantially less colored. In effect, this was a tissue web having a finished basis weight of 8.8 pounds per 2880 square feet.

Example 7

Cationic Direct Dye (Blue)

A white single-ply uncreped tissue web, having a finished basis weight of 12.5 pounds per 2880 square feet and a furnish consisting of 60 percent hardwood and 40 percent softwood fibers, was printed on one side with a blue cationic direct dye (Aquonium Turquoise supplied by Hilton-Davis Co., Cincinnati, Ohio). The printer (Arrow Equipment Mfg.) had a rubber impression roller having a 70 Shore A hardness. The gravure cylinder had mechanical etched cells having a cell volume of 430 million cubic microns per square inch of gravure cylinder surface. Each cell had an open top area of 6000 square microns and a cell depth of about 10 microns. Tissue surface area coverage was about 13 percent. Dye add-on, determined by quantitative analysis, was 0.21 milligrams per square inch. The resulting tissue appeared to be solid blue on one side when viewed with the naked eye. The other side of the tissue was white. Hunterlab Color measurements for the printed side of the tissue web were: Rd=70.92; a=−11.47; b=−10.92. Hunterlab Color measurements for the unprinted side of the tissue web were: Rd=74.30; a=−8.23; b=−8.76. This indicates the unprinted side of the one-ply product remained substantially uncolored.

Example 8

Cationic Direct Dye (Blue)

Overall printing of an uncreped tissue web was carried out as described in Example 7. The uncreped tissue web was subsequently creped (finished basis weight 15.6 pounds per 2880 square feet). Hunterlab Color measurements for the printed side of the tissue ply were: Rd=72.96; a=−11.85; b=−10.78. Hunterlab Color measurements for the unprinted side of the tissue ply were: Rd=78.04; a=−8.58; b=−7.32. This indicates the unprinted side of the tissue ply was substantially uncolored.

The foregoing examples, given for purposes of illustration, are not to be construed as limiting the scope of this invention, which is defined by the following claims.

We claim:

1. A method of making a colored creped tissue web comprising printing the surface of one side of a dry, creped tissue web with a colorant applied in a pattern of small colored areas such that substantially the entire surface of the printed side of the creped tissue web macroscopically appears to be a solid color while the unprinted side of the creped tissue web appears to be substantially uncolored, wherein the percentage of the surface area of the printed side of the creped tissue web covered by the small colored areas is from about 5 to about 25 percent and wherein the properties of the creped tissue web are substantially unaffected.

2. The method of claim 1 wherein the percentage of the surface area of the overall pattern covered by the small colored areas is from about 5 to about 15 percent.

3. The method of claim 1 wherein the tissue web is embossed immediately after printing.

4. The method of claim 1 wherein the amount of colorant printed onto the web is from about 0.1 to about 3 milligrams per square inch of surface per side.

5. The method of claim 1 wherein the amount of colorant printed onto the web is from about 0.2 to about 1.5 milligrams per square inch per side.

6. The method of claim 1 wherein the creped tissue web is colored by rotogravure printing.

7. The method of claim 1 wherein the colored creped tissue web has a density of from about 0.1 to about 0.3 grams per cubic centimeter.

8. The method of claim 1 wherein the colored creped tissue web has an absorbency from about 5 to about 9 grams of water per gram of fiber.

9. The method of claim 1 wherein the colored creped tissue web is a bath tissue.

10. A method of making a colored creped tissue web comprising printing the surface of one side of a dry, creped tissue web with a colored dye in an amount of from about 0.1 to about 3 milligrams per square inch of surface, said colored dye applied in a pattern of small colored areas such that substantially the entire surface of the printed side of the creped tissue web macroscopically appears to be a solid color while the unprinted side of the creped tissue web appears to be substantially uncolored, wherein the percentage of the surface area of the printed side of the creped tissue web covered by the small colored areas is from about 5 to about 25 percent and wherein the properties of the creped tissue web are substantially unaffected.

11. The method of claim 10 wherein the amount of colored dye printed onto the tissue web is from about 0.2 to about 1.5 milligrams per square inch of surface per side.

12. The method of claim 10 wherein the percentage of the surface area of the overall pattern covered by the small colored areas is from about 5 to about 15 percent.

* * * * *